US006648063B1

(12) United States Patent
Andraka et al.

(10) Patent No.: US 6,648,063 B1
(45) Date of Patent: Nov. 18, 2003

(54) HEAT PIPE WICK WITH STRUCTURAL ENHANCEMENT

(75) Inventors: Charles E. Andraka, Albuquerque, NM (US); Douglas R. Adkins, Albuquerque, NM (US); James B. Moreno, Albuquerque, NM (US); K. Scott Rawlinson, Albuquerque, NM (US); Steven K. Showalter, Albuquerque, NM (US); Timothy A. Moss, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/547,966

(22) Filed: Apr. 12, 2000

(51) Int. Cl.[7] ..... F28D 15/00
(52) U.S. Cl. ..... 165/104.26; 165/47
(58) Field of Search ..... 165/104.26, 47

(56) References Cited

U.S. PATENT DOCUMENTS

| | | | | | |
|---|---|---|---|---|---|
| 3,786,861 | A | * | 1/1974 | Eggers | 165/104.26 |
| 3,789,920 | A | * | 2/1974 | Low et al. | 165/104.26 |
| 3,857,441 | A | * | 12/1974 | Arcella | 165/104.26 |
| 4,007,777 | A | * | 2/1977 | Sun et al. | 165/104.26 |
| 4,011,104 | A | * | 3/1977 | Basiulis | 165/104.26 |
| 4,043,387 | A | * | 8/1977 | Lamp | 165/104.26 |
| 4,196,504 | A | * | 4/1980 | Eastman | 165/104.26 |
| 4,437,510 | A | * | 3/1984 | Martorana | 165/104.26 |
| 5,002,122 | A | * | 3/1991 | Sarraf et al. | 165/104.26 |

FOREIGN PATENT DOCUMENTS

| | | | | |
|---|---|---|---|---|
| GB | 1402509 | * | 8/1925 | 165/104.26 |
| JP | 0116094 | * | 9/1980 | 165/104.26 |
| JP | 0042094 | * | 4/1981 | 165/104.26 |
| JP | 0144890 | * | 9/1982 | 165/104.26 |
| SU | 0800577 | * | 1/1981 | 165/104.26 |
| SU | 1002800 | * | 3/1983 | 165/104.26 |
| SU | 1191726 | * | 11/1985 | 165/104.26 |

OTHER PUBLICATIONS

Pergamon International Library of Science, Technology, Engineering and Social Studies; Publisher: Robert Maxwell, M.C.; Dunn & Reay; Heat Pipes, Third Edition, Pgs. 59–65.

* cited by examiner

*Primary Examiner*—Christopher Atkinson
(74) *Attorney, Agent, or Firm*—Russell D. Elliott

(57) ABSTRACT

Heat pipe wick structure wherein a stout sheet of perforated material overlays a high performance wick material such as stainless steel felt affixed to a substrate. The inventive structure provides a good flow path for working fluid while maintaining durability and structural stability independent of the structure (or lack of structure) associated with the wick material. In one described embodiment, a wick of randomly laid ~8 micron thickness stainless steel fibers is sintered to a metal substrate and a perforated metal overlay.

9 Claims, 3 Drawing Sheets

HEAT PIPE WICK WITH STRUCTURAL ENHANCEMENT

This invention was made with support from the United States Government under Contract DE-AC04-96AL85000 awarded by the U.S. Department of Energy. The Government has certain rights in this invention.

BACKGROUND OF THE INVENTION

1. Field of the Invention

This invention pertains generally to heat pipe wicks, and more specifically to high performance heat pipe wick structures including those comprising wick materials of 90% or greater porosity.

2. Description of the Related Art

Heat pipes are used in a variety of applications requiring heat transfer mechanisms for transport of thermal energy from one location to another. Heat pipes accomplish energy transfer through vaporizing a liquid in a closed system near a heat source and recondensing the liquid at a different location. Typically, heat pipes include a wick structure that wets with the working fluid to distribute it across a large surface area evaporator thereby facilitating vaporization.

High wick permeability offers low fluid resistance and allows the wick to recharge as vapor evolves off the wick. The result is that, with greater permeability (which often is associated with high porosity), more liquid is supplied during application of heat, and therefore, more heat can be transferred without wick dryout. An open structure made of very little material, however, is structurally weak. Consequently, wicks with high porosity and excellent fluid flow characteristics tend to lack durability in the absence of other mechanical support.

Typical wick structures deployed, for example, in dish Stirling solar engines, use either powdered metallurgy or woven wire screens to provide the wicking pores. Although these have limited porosity and permeability, they usually have good structural and durability properties due to the large amount of internal structure they exhibit. Durability is required, for example, in Stirling engines, where the liquid to be evaporated (for example, molten sodium) is carried upward from a reservoir through a wick by, capillary movement. As the wick becomes loaded, the weight of the liquid in the wick exerts pressure that, without sufficient support to counteract the load, can cause the wick to deform or collapse. For low porosity wicks, the mechanical load can be supported by the internal wick structure, itself. However, for higher porosity wicks, such as those comprising randomly-laid fine metal fibers, collapsing (or inflating, where bubbles disrupt wick integrity) pose a serious challenge, especially where wick lifetimes of tens of thousands of hours are desired.

A need remains, therefore, for heat pipe wick structures that exhibit high porosity and permeability but are durable and can withstand, over the long term, mechanical loads and stresses encountered during normal operation.

SUMMARY OF THE INVENTION

It is an object of the present invention to provide wick structures that include wick material characterized by high permeability in a structurally durable configuration.

It is another object of the invention to provide a wick structure that utilizes the very high wicking performance of ultra-thin metal fiber mats, without structural deficiencies that impair long-life operation.

It is another object of the invention to provide a wick structure that is self-priming and fault-tolerant.

It is another object of the invention to provide a felt metal wick that is resilient to mechanical loads leading to deformation.

These and other objects are fulfilled and satisfied by the claimed invention which includes a heat pipe wick structure characterized by a mat of high performance wicking material, such as a felt comprising randomly laid micro-thin fibers. According to the invention, the mat of wicking material is joined on one side to a rigid substrate, and on the other side to a stout sheet of perforated material, serving as an exoskeleton. According to one embodiment, the fibers comprise stainless steel fibers of about 8 microns thickness, and the fibers are bound to each other and to the substrate and a rigid metal exoskeleton by way of sintering. Additional embodiments falling within the scope of the claims employ various other materials, joining means and structures appropriate to fulfilling the objectives of the invention.

Additional advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

According to the invention, efficient, but perhaps structurally weak wicking material is supported in a mechanically sound and durable sandwich-style configuration. The inventive heat pipe wick is characterized by wicking material, generally in the shape of a strip or mat, for example, supported on one side by a substantially rigid substrate and on the other side by a substantially rigid porous exoskeleton. The wick material, substrate and porous exoskeleton are all bonded together to form an integrated structure that is easily manufactured in a limited number of steps, and can withstand stresses associated with functioning of high performance heat pipe wicks.

Figure 1:
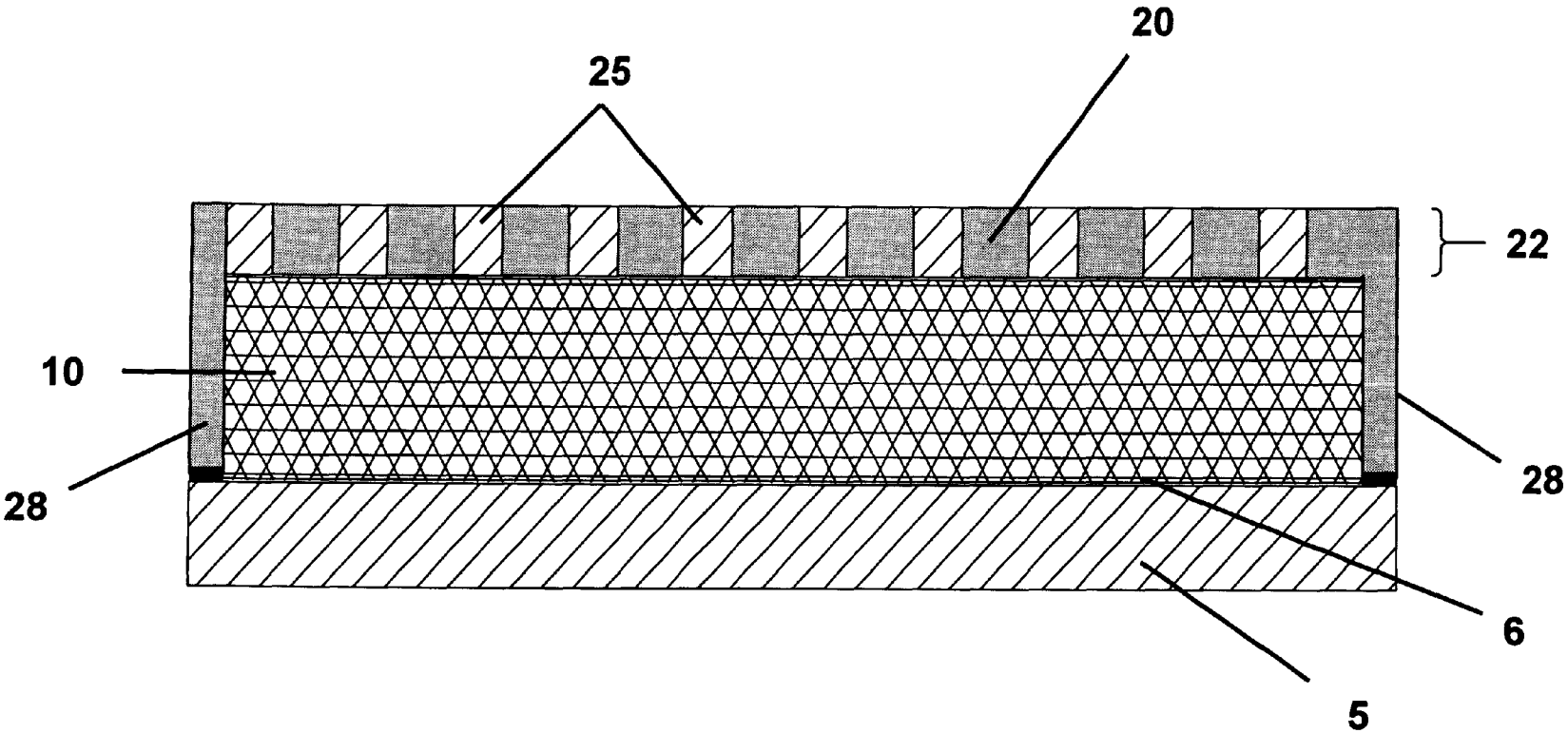
FIG. 1 is a schematic illustration showing a cross section of a wick structure assembled according to the principles of the invention.

FIG. 1 shows a cross section of the basic elements of the inventive heat pipe wick structure. For convenience, this structure is illustrated in FIG. 1 according to an arbitrary horizontal orientation. Elements described in this portion of the specification are described according to their positioning relative to this arbitrary horizontal reference. Such descriptions are intended to assist the reader in understanding the positioning of the various recited elements in relation to each other. It is to be understood, however, that an assembled device according to the description provided here can be oriented in space in any position which principles of operation of the device will allow.

As illustrated in FIG. 1, a substantially planar substrate 5 is provided which includes a surface 6. In a functional heat pipe, the substrate 5 may serve, for example, as the outer shell of the heat pipe. Affixed to the surface 6 is wicking material 10 positioned so that it forms a layer atop the surface of the substrate. Then, affixed atop the wicking material 10 is shell or exoskeleton 20 comprising a planar feature 22 including pores 25. The planar feature 22 of the exoskeleton 20 is maintained at a substantially uniform distance from the substrate 5, with the wick material 10 therebetween, by the function of separation means 28. The separation means 28 may take various forms including any number of load-bearing posts, standoffs, or beams. However, an uncomplicated application of this principle of the invention is simply to construct the exoskeleton 20 to include edges extending at right angles (or otherwise outwardly) from the planar feature 22, so that the edges abut the substrate 5. Similarly, a single continuous edge about the periphery of the exoskeleton 20 may be employed in place of separate edges. In any case, the wick material 10 is bound both to the substrate 5 and to the exoskeleton 20. Because of the rigidity of the exoskeleton planar feature 22 combined with the mechanical support provided by the separation means 28, the wick material 10 is supported against the mechanical strains described earlier. This is possible, largely, without regard to what type of wick material is used.

As noted, the various elements just described, including the substrate 5, the wick material 10 and the exoskeleton 20 need to be securely bonded together. A favorable embodiment for many applications is to use a metal felt wick (e.g. comprised of stainless steel fibers) together with a metal (e.g., stainless steel) substrate and exoskeleton. A good bond can be achieved by using a sintering process, however, this can in some cases be enhanced, for example, by grit blasting the surfaces of the exoskeleton and substrate prior to sintering, to enhance adhesion. Likewise, a thin coating of braze material such as electroplate nickel or electroless nickel plating can be used.

Figure 2B:
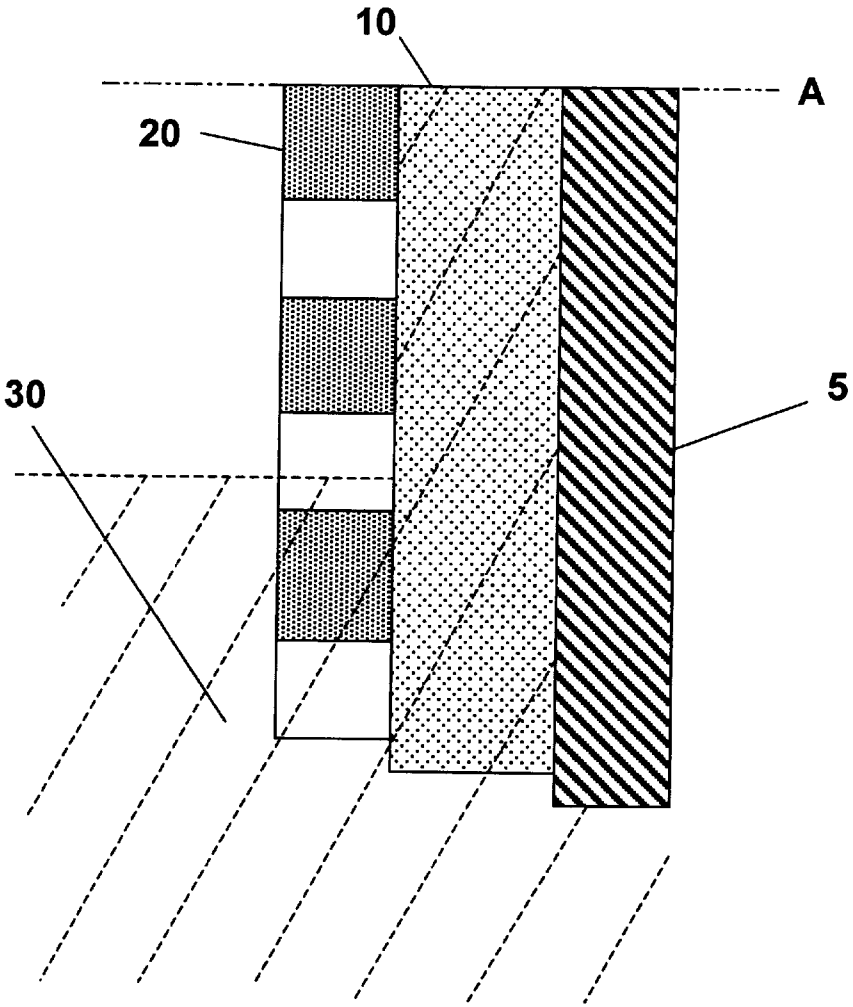
FIG. 2*b* shows additional detail over that shown in FIG. 2*a*.
Figure 2A:
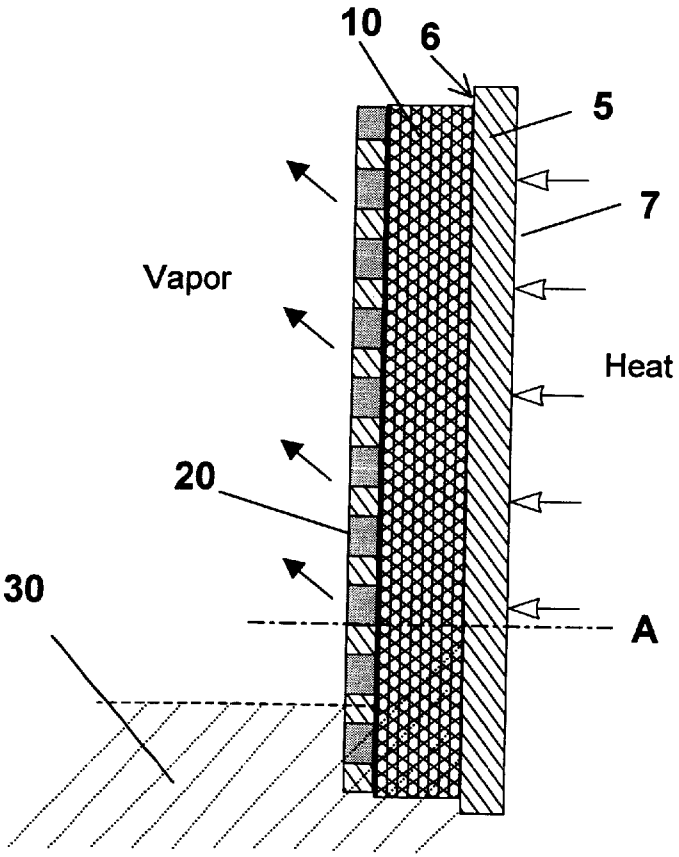
FIG. 2*a* is a schematic illustration of a cross section of the inventive wick structure, depicted in an operational configuration.
Figure 3B:
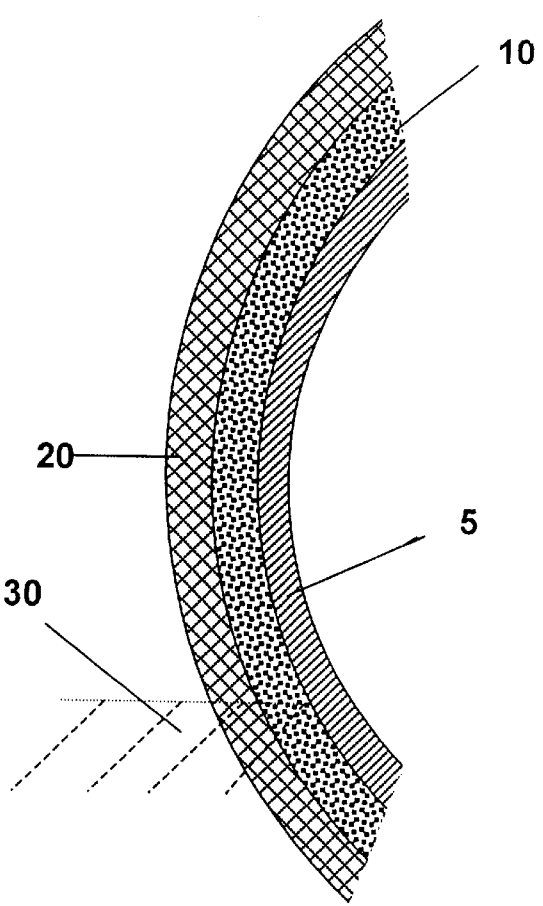
FIGS. 3*a* and 3*b* illustrate an alternatives to the wick structure embodiment shown in FIG. 2*a* in which curved elements are used, rather than simple planar elements.
Figure 3A:
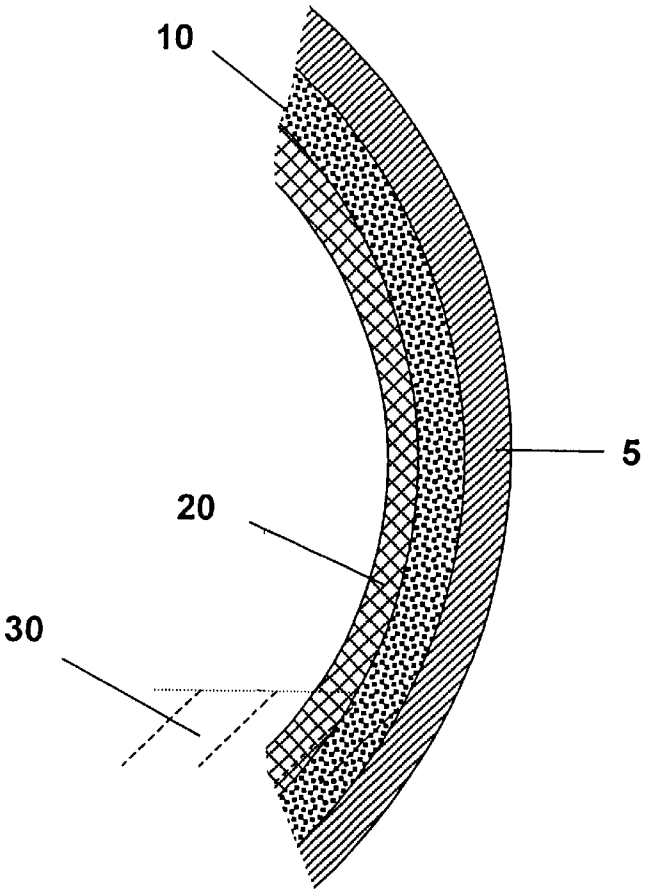

FIG. 2*a* illustrates a functional embodiment of the present invention. The Figure shows a cross section similar to that illustrated in FIG. 1, but in this instance a portion of a heat pipe wick structure is shown as it might be oriented, for example, for use in a Dish Stirling engine. The heat pipe wick structure is positioned so that a portion of it is immersed in a reservoir of condensed working fluid 30. A substrate 5 of rigid or semi-rigid material is provided. As previously explained, the substrate 5 includes a surface 6 that generally describes, for example, a plane or shallow curvature having a surface area. In the case of a Dish Stirling engine, the substrate is typically in the form of a complete or partial hollow sphere, with the surface 7 defining the interior spherical boundary. (FIGS. 3*a* and 3*b* illustrate structures similar to that of FIG. 2*a*, but instead depicts partial spherical components. The inventive principles are applicable to planar and both convex and concave orientations, as shown in the figures.)

As further illustrated in FIG. 2*a* (consistent also with FIG. 3) the wick material 10 is affixed to the substrate 5 in a layer that, but for its thickness, assumes generally the same shape as the planar or curved substrate 5. (For simplicity of illustration, although it is necessary in all embodiments of the invention, the separation means described in connection with FIG. 1 is not shown in the remaining figures.) The result is a sandwich-type structure wherein the wick material is supported between the substrate and the exoskeleton.

The arrows in FIG. 2*a* show that when heat (light arrows) is applied to the substrate 5, working fluid present in the wick material 10 evaporates (dark arrows) through the pores in the exoskeleton 20. FIG. 2*b* illustrates that the condensed working fluid 30 travels, by way of capillary action, upward through the wick material so as to permeate all or part of the wick across a large area. Heat encountered and absorbed by the substrate 5 raises the temperature of the wick material 10 as well as the working fluid suspended therein. As a result, during operation of the heat pipe, the working fluid evaporates rapidly and working fluid vapor travels through the pores and away from the wick structure to another location in the heat pipe apparatus, where it ultimately re-condenses. In this way, heat energy transfers from one location in the heat pipe to another. After condensing, working fluid returns to the wick structure where it is then available for evaporation again. Various paths can be designed into the system to allow condensed working fluid to replenish the wick. For example, condensed working fluid may, due to the force of gravity, trickle back into a reservoir of working fluid 30, such as is depicted in the figure. From there, it again enters the wick as a result of capillary action drawing liquid into the wick. In another example, liquid returns directly to the wick via direct ducting from the location of condensation (or from another location). Yet another example includes the case wherein an extension of the wick, itself, carries fluid directly from the location of condensation, thereby replenishing the wick. These and other fluid transport mechanisms are known to those skilled in the art of heat pipe manufacture and operation. In a properly functioning system, which includes both adequately porous wick material as well as a path for condensate to replenish the working fluid reservoir, the wick will continuously be recharged as evaporation takes place.

In one embodiment, which has been shown to be operational, elements of the entire wick structure (including the substrate, wick material and exoskeleton) were positioned as described herein and secured in a single sintering run at a temperature of about 1100 C. In this example, stainless steel was used for both the substrate and exoskeleton. Stainless steel felt comprising randomly laid fibers (about 8 microns in thickness) was used as the wick material. In order to keep the materials from oxidizing, the sintering was performed in the absence of oxygen. In practice, this may be accomplished in a variety of ways, such as by performing the sintering step in either a vacuum or in an inert or reducing atmosphere. The wick structure just described was shown to function efficiently in a Dish Stirling engine with molten sodium.

The approach just described illustrates another key advantage of the present invention. The exoskeleton, in addition to providing support for the wick material, enables self-fixturing of the wick structure elements during the step of bonding the elements together. The process of sintering the assembled elements in place simplifies fabrication and promotes clean construction of wick structures. Wicks that are not assembled using a single sintering step performed within a sealed system run the risk of being exposed to air. Air, in turn, can cause the deposition of an oxide layer on wick components. This, in the case of systems using sodium as the working fluid, can defeat or interfere with operation of the heat pipe. Although the invention is well suited to the one-step assembly and sintering just described, other methods of assembly may also be used and still fall within the scope and intent of the claims.

Other embodiments are contemplated wherein other materials and bonding techniques are utilized, but still employing the inventive principles. For example, the use of wick material sandwiched between an exoskeleton shell and a substrate is beneficial even where wick material of less than 90% porosity is used. Accordingly, sintered powder wicks and others in common use can be enhanced structurally using the invention. Likewise, even non-metal structures, for a variety of heat pipe applications using different working fluids, can be assembled according to the principles outlined in this disclosure. For example, plastic components including plastic wick materials may be securely joined by means of various known adhesives, and used advantageously in the configuration of the present invention. Additionally, wick structures can be manufactured using wood chips or other natural or man-made fibers or cells as wick material. In such cases various agents, such as epoxy or cyanoacrylate adhesive, may be used to bond the pieces of wick material to each other and also to bond the substrate and exoskeleton elements to the wick material. In these cases, bonding can be accomplished by a variety of methods. For example, an assembly can be pieced together and then secured in one step, as by dipping the entire assembly in a glue or other bonding agent. Alternatively, pieces can be built up and bonded together in a step-by-step fashion or sequence.

The invention being thus described, it will be obvious that the same may be varied in many ways. Such variations are not to be regarded as a departure from the spirit and scope of the invention, and all such modifications as would be obvious to one skilled in the art are intended to be included within the scope of the appended claims. It is intended that the scope of the invention be defined by the claims appended hereto. The entire disclosures of all references, applications, patents and publications cited above are hereby incorporated by reference.

We claim:

1. A heat pipe wick structure comprising:

a rigid substrate including a surface, porous wick material affixed to the surface of the rigid substrate, a rigid exoskeleton including pores affixed to the porous wick material whereby the porous wick material is disposed between the rigid substrate and the rigid exoskeleton, and at least one rigid element separating the rigid exoskeleton from the rigid substrate.

2. The heat pipe wick structure of claim 1 wherein the porous wick material is stainless steel felt.

3. The heat pipe wick structure of claim 2 wherein the rigid exoskeleton and the rigid substrate comprise metal.

4. The heat pipe wick structure of claim 3 wherein the rigid exoskeleton, the porous wick material, and the rigid substrate are all sintered together.

5. The heat pipe wick structure of claim 4 further comprising brazing material between the porous wick material and elements selected from the group consisting of the rigid exoskeleton, the rigid substrate, and both the rigid exoskeleton and rigid substrate.

6. The heat pipe wick structure of claim 4 wherein elements selected from the group consisting of the rigid exoskeleton, the rigid substrate, and both the rigid exoskeleton and rigid substrate are grit blasted.

7. The heat pipe wick structure of claim 5 wherein elements selected from the group consisting of the rigid exoskeleton, the rigid substrate, and both the rigid exoskeleton and rigid substrate are grit blasted.

8. The heat pipe wick structure of claim 1 wherein the wick material. is nonmetallic.

9. The heat pipe wick structure of claim 2 wherein the wick material is selected from the group consisting of wood, plastic, non-wood natural fibers, non-wood natural cells, non-plastic man-made fibers, and non-plastic man-made cells.

* * * * *